United States Patent [19]

Sonnenberg

[11] 3,984,965

[45] Oct. 12, 1976

[54] DEVICE FOR APPLYING CAPS TO BOTTLES

[75] Inventor: Rudolph Sonnenberg, Belvidere, Ill.

[73] Assignee: Harry Crisci, New Castle, Pa.

[22] Filed: Sept. 19, 1974

[21] Appl. No.: 507,578

[52] U.S. Cl. ..... 53/331.5; 53/345

[51] Int. Cl.[2] ..... B67B 3/20; B65B 7/28

[58] Field of Search ..... 53/331.5, 317, 344, 53/345, 346, 364, 354, 365, 329, 334

[56] References Cited

UNITED STATES PATENTS

| | | | |
|---|---|---|---|
| 1,249,025 | 12/1917 | Carvalho | 53/354 X |
| 1,290,706 | 1/1919 | Brenzinger | 53/334 X |
| 1,856,827 | 5/1932 | Carruthers | 53/317 |
| 2,749,003 | 6/1956 | Zimmermann | 53/345 X |
| 2,835,093 | 5/1958 | Ford et al. | 53/345 |
| 3,031,822 | 5/1962 | Dimond | 53/331.5 X |
| 3,906,706 | 9/1975 | Conti | 53/331.5 |

*Primary Examiner*—Travis S. McGehee
*Assistant Examiner*—Horace M. Culver
*Attorney, Agent, or Firm*—Webster B. Harpman

[57] ABSTRACT

A device for engaging a bottle cap and turning it on to the threaded finish of a bottle pivotally mounts a plurality of segments in a circumferential pattern with portions of the segments having vertical surfaces for engagement with the sides of the bottle cap and other portions extending inwardly radially and provides a lifting member for engaging the same so as to pivot the segments and move them toward and away from the sides of a bottle cap being rotated by the device.

5 Claims, 3 Drawing Figures

DEVICE FOR APPLYING CAPS TO BOTTLES

BACKGROUND OF THE INVENTION

1. Field of the Invention

This invention relates to devices for applying bottle caps to bottles and sometimes termed "cappers" and wherein a cap is engaged and rotated into position on the threaded neck of a bottle and released in a rapid automatic cycling of the capper.

2. Description of the Prior Art

Prior structures of this type have employed flexible jaws including annular resilient members and various means for moving the flexible jaws or the annular members into and away from engagement with the sides of a bottle cap while the same is being initially gripped rotated and released in the capping operation.

This invention provides a simplified construction in which several arcuate shaped segments are alternately moved and released in accomplishing a desired engagement with the cap and its subsequent release after rotation.

SUMMARY OF THE INVENTION

A device for applying caps to bottles includes a support member movable relative to the bottles to be capped and rotatable with respect thereto and incorporates several movable arcuate segments, portions of which are arranged to engage the cap and portions of which extend to a common actuator. The arrangement of the common actuator and the movable segments and the formation of the segments themselves is such that they are moved to cap engaging position by the common actuator and they move to open position by gravity upon being disengaged by the common actuator.

DESCRIPTION OF THE PREFERRED EMBODIMENT

Figure 1:
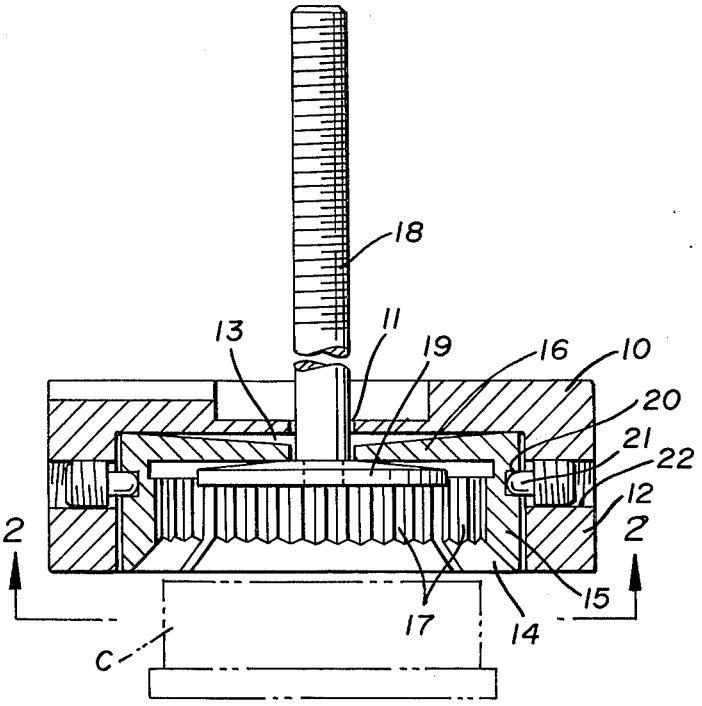
FIG. 1 is a cross sectional side elevation of a capper with broken lines indicating a cap disposed therebelow.
Figure 2:
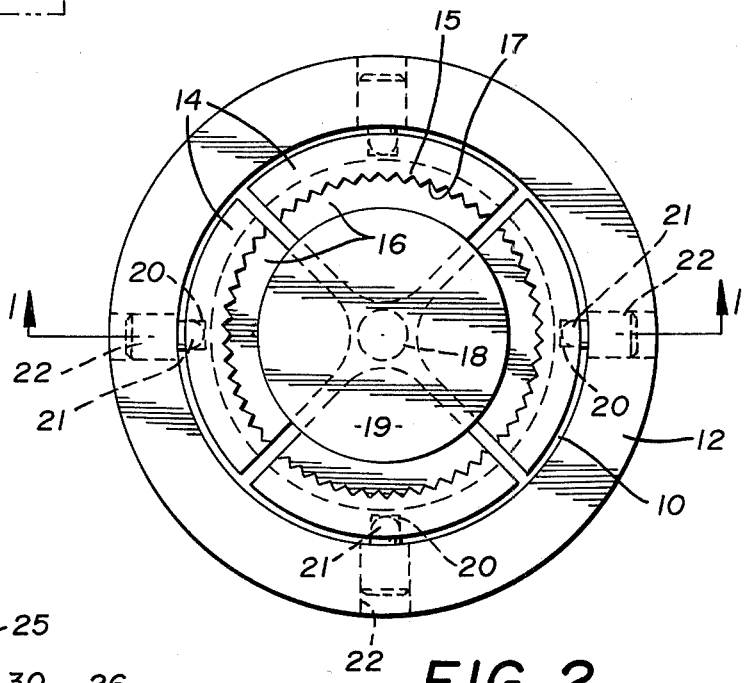
FIG. 2 is a bottom elevation on line 2—2 of FIG. 1.

By referring to FIGS. 1 and 2 of the drawings, it will be seen that a device for applying caps to bottles sometimes termed a capper and more particularly the actual cap engaging portions of such a device have been illustrated as comprising a support member 10 centrally apertured as at 11 and having a depending annular flange 12 defining a circular cavity 13 of a size greater than a bottle cap such as shown in broken lines and indicated by the letter C.

A plurality of arcuate segments 14 are positioned in circumferentially spaced relation within the circular cavity 13. Each of the arcuate segments 14 has a vertical portion 15 and a horizontal portion 16. The inner opposed surfaces of the vertical portions 15 are ribbed vertically as at 17 for improved frictional engagement with the outer sides of the caps C which are usually provided with matching vertical rib configurations as may be seen in the Crisci patent, U.S. Pat. No. 3,504,818, of Apr. 7, 1970 in which a typical, expendible bottle and cap therefor is disclosed.

The horizontal portions 16 of the arcuate segments 14 extend inwardly toward one another and terminate short of a shaft 18, the lower end of which is affixed to a disc 19 which is of smaller diameter than the space between the inner opposed surfaces of the vertical portions 15 of the segments 14. The disc 19 underlies the inner ends of the horizontal portions 16 of the arcuate segments 14 so that they can be lifted uniformly thereby upon vertical movement of the shaft 18.

The arcuate segments 14 are maintained in the support member 10 by cavities 20 in their outer, uppermost, vertical portions engaging circumferentially spaced, inwardly extending pivots 21, portions of which comprise threaded bodies engaged in threaded openings 22 in the support member 10. The arrangement and structure is such that each of the arcuate segments 14 pivots on its respective pivot 21.

OPERATION

In operation the support member 10 is affixed to bottle capping apparatus arranged to rotate the same and move it vertically with respect to bottles and caps to be applied thereto as will be understood by those skilled in the art. The shaft 18 is arranged to be moved vertically by the capping apparatus so as to actuate the arcuate segments 14. The support member moves downwardly so as to position the cap C within the circular chamber 13 and between the several arcuate segments 14. The shaft 18 is then moved vertically to elevate the disc 19 which lifts the inner ends of the horizontal portions 16 of the arcuate segments 14 and the resultant pivoting motion of each of the arcuate segments 14 moves the inner opposed, arcuate surfaces of the vertical portions 15 of the arcuate sections 14 against the outer surfaces of the cap C. Rotating motion then applied to the support member 10 turns the cap C onto the threaded neck or finish of the bottle, the shaft 18 is then moved downwardly whereupon the weight and the over balancing arrangement of the horizontal portions 16 of the arcuate sections 14 causes the vertical portions 15 thereof to move outwardly and disengage the cap whereupon the support member 10 moves upwardly and away from the capped bottle which is replaced by another bottle for a repeat of the cap applying action. The device for applying a cap to a bottle as disclosed herein is capable of being actuated by any one of a number of existing capping machines, such as are known in the trade as FEDERAL and HASCON for example.

Figure 3:
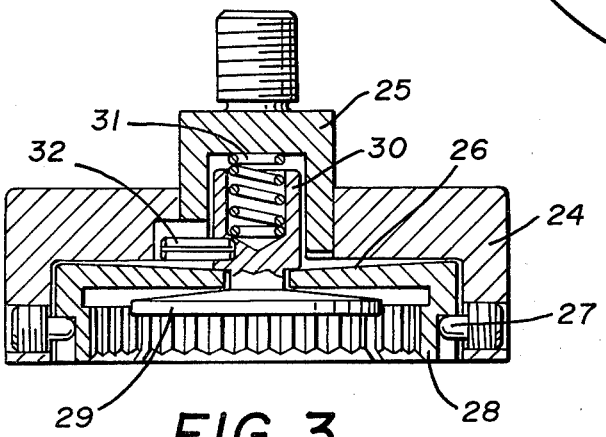
FIG. 3 is a cross sectional side elevation of a capper showing a modification.

Modifications of the device hereinbefore described will occur to those skilled in the art and one such modification is illustrated in FIG. 3 and which is particularly adapted for use with HASCON capping machine.

By referring to FIG. 3 of the drawings, it will be seen that a support member 24 has a centrally disposed, upwardly extending portion 25 affixed thereto, the inner portion of which is hollow and which communicates with a circular chamber 26 formed in the support member 24. A plurality of circumferentially spaced pivots 27 extend into the circular chamber 26 and pivotally mount a plurality of arcuate segments 28. An actuator disc 29 underlies the inner horizontal portions of the arcuate segments 14 and has a central vertical portion 30 extending thereabove which cages the spring 31 and is urged thereby downwardly with respect to the extended portion 25 of the support member 24. A guide pin 32 in the upward extension 30 of the disc 29 is provided. In operation the support member 24 is moved downwardly over a cap on a bottle with the engagement of the cap on the disc 29 causing the same to move upwardly against the spring 31 and lift the inner ends of the horizontal portions of the arcuate segments 28 so that they pivot and their innermost surfaces move into engagement with the sides of the cap. The support member 24 is then revolved to turn the cap onto the bottle whereupon the device is moved upwardly away from the capped bottle and the spring 21 repositions the disc 29 to simultaneously permit the inner ends of the horizontal portions of the arcuate segments 28 to move downwardly and thereby cause the disengagement of the vertical portions of the arcuate segments 28 with respect to the cap.

It will thus be seen that a simple and efficient device for applying caps to bottles has been disclosed which utilizes the shape and weight of the circumferentially positioned arcuate segments to move relative to the cap and insure the release of the cap therefrom without dependence upon any other action or device.

Having thus described my invention what I claim is:

1. A device for engaging the exterior of an internally threaded bottle cap and turning it on to the threaded finish of a bottle comprising a horizontally disposed support member having a depending annular flange on its peripheral edge, a plurality of segments arranged in spaced relation in a circle within said annular flange, each segment having a substantially horizontal portion, the outer edge of which is curved to correspond to said circle and a similarly curved substantially vertical portion depending therefrom, inwardly extending pivots adjustably positioned in apertures in said depending flange, said pivots being circumferentially spaced and each positioned for engagement with an aperture in said curved vertical portion of one of said segments, an actuating member underlying the horizontal portions of said segments and arranged for movement toward and away therefrom so as to move said horizontal portions of said segments upwardly and said depending portions of said segments inwardly into engagement with said bottle cap, and wherein said horizontal portions of said segments are arranged to move downwardly by gravity when disengaged by said actuating member so as to move said depending portions radially outwardly away from said bottle cap.

2. The device of claim 1 and wherein said horizontally disposed support member is centrally apertured and a vertical extension is formed on said actuating member and located in said central aperture so as to extend upwardly and outwardly of said support member.

3. The device of claim 1 wherein the innermost surfaces of the vertical portions of said segments are arcuate.

4. The device of claim 1 wherein the innermost surfces of the vertical portions of said segments are arcuate and ribs are formed vertically on said arcuate innermost surfaces.

5. The device of claim 1 and wherein the innermost surfaces of the vertical portions of said segments are spaced to define a cavity for the reception of one of said bottle caps.

* * * * *